United States Patent [19]

Böcker et al.

[11] Patent Number: 4,597,333

[45] Date of Patent: Jul. 1, 1986

[54] TWO-PART ARMOR-PIERCING PROJECTILE

[75] Inventors: Jürgen Böcker, Oberhausen; Peter Wallow, Düsseldorf, both of Fed. Rep. of Germany

[73] Assignee: Rheinmetall G.m.b.H., Düsseldorf, Fed. Rep. of Germany

[21] Appl. No.: 628,753

[22] Filed: Jul. 9, 1984

[30] Foreign Application Priority Data

Jul. 8, 1983 [DE] Fed. Rep. of Germany ..... 3324681

[51] Int. Cl.[4] ..... F42B 13/06

[52] U.S. Cl. ..... 102/518; 102/489

[58] Field of Search ..... 102/501, 517, 518, 519, 102/489, 340, 342, 351, 357

[56] References Cited

U.S. PATENT DOCUMENTS

| | | | |
|---|---|---|---|
| 2,804,823 | 9/1957 | Jablansky | 102/476 |
| 3,545,383 | 12/1970 | Lucy | 102/517 |
| 4,112,846 | 9/1978 | Gilbert et al. | 102/517 |
| 4,497,253 | 2/1985 | Sabranski | 102/476 |

*Primary Examiner*—Harold J. Tudor

[57] ABSTRACT

A composite armor-piercing subcaliber projectile has a front projectile part generally centered on an axis and having a rearwardly extending cylindrical sleeve of predetermined outer diameter and also generally centered on the axis and a rear projectile part centered on the axis and having a cylindrical outer surface substantially of the outer diameter and having a small-diameter forwardly extending projection fitting complementarily within the sleeve. An explosive charge between the front and rear parts can be detonated, as for example by a proximity fuse, to push the front part axially forward away from the rear part. The front part and sleeve can be unitary. In addition the front part can be tubular and centered on the axis. Furthermore the sleeve can be separate from the front and rear parts and have a front tube centered on the axis and at least partially containing the front part, a rear tube also centered on the axis and at least partially containing the rear part, and a central crosswise partition separating the tubes. It is even possible for the rear part to have a forward extension that projects through a tubular front part, serving during separation to guide the front part and serving thereafter to ballistically guide the projectile.

14 Claims, 9 Drawing Figures

FIG. 1
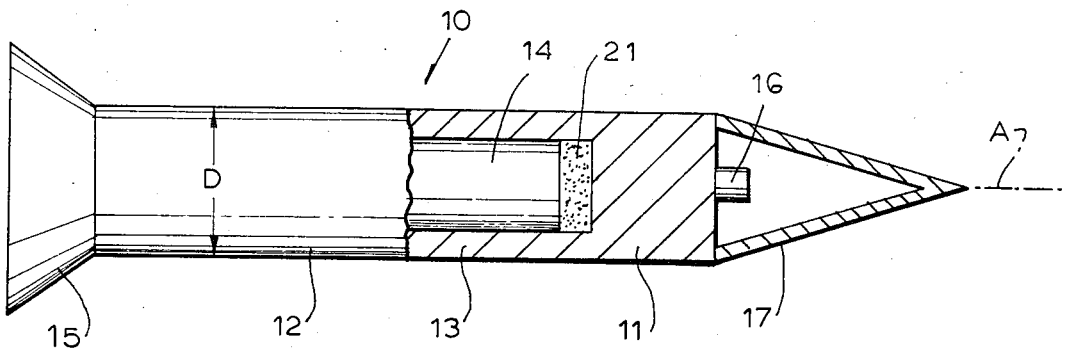
FIG. 2
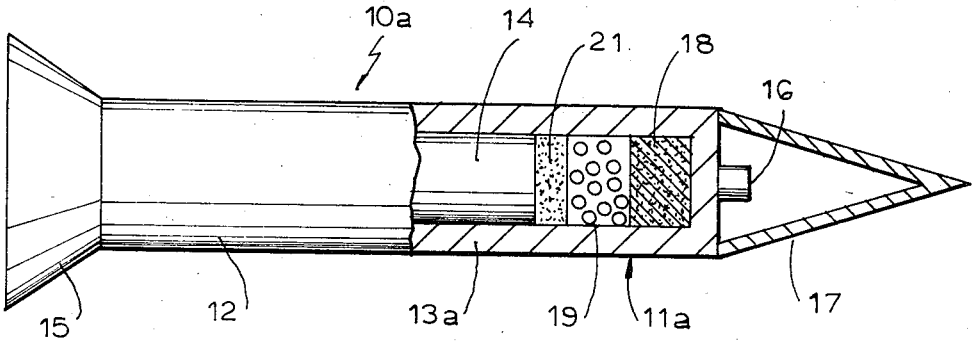
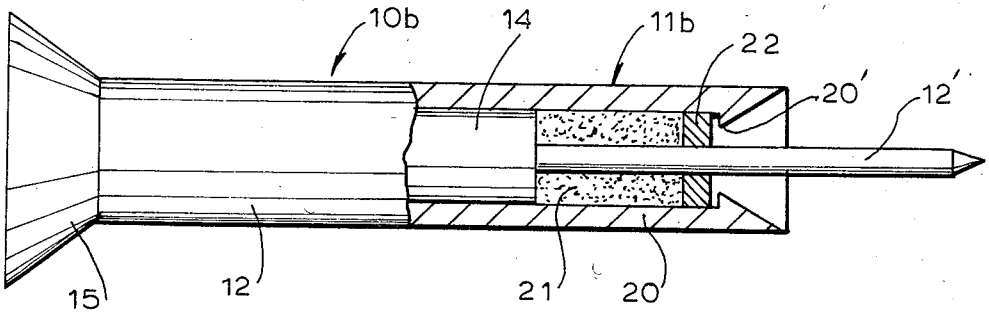
FIG. 3

TWO-PART ARMOR-PIERCING PROJECTILE

FIELD OF THE INVENTION

The present invention relates to a composite artillery projectile. More particularly this invention concerns a two-part armor-piercing projectile.

BACKGROUND OF THE INVENTION

Standard armor for a tank, personnel carrier, mobile gun, or the like has been improved since the days of thick plating or built-up laminated plates. The major modern development is so-called active armor which contains an interference charge that explodes when hit by a projectile to destroy or deflect this projectile, thereby preventing it from penetrating.

As disclosed in commonly owned U.S. applications Nos. 213,171 and 295,551 a projectile for attacking multiple-layer, or active armor of an armored vehicle such as a tank, personnel carrier, or weapons carrier has a main device and an auxiliary device. These devices are generally similar in configuration and nature with the main device being larger than the auxiliary device and at least the auxiliary device forming an armor-piercing or -breaking unit. In such a projectile the point of the auxiliary device is effective on the target before that of the main device, facilitating the armor-piercing or -breaking effect. Normally the main device has an elongated impact or inertial projectile which works against the target substantially by impact, that is by transmitting its kinetic energy to the target. The secondary device can be similarly of the impact type.

In addition in this prior-art system the main device has a target-sensing device which accelerates the auxiliary projectile relative to the main projectile when the target is sensed. Thus the auxiliary projectile will strike the target first. This is achieved by forming the main projectile as a barrel-like tube receiving the secondary projectile and a charge for firing it from the main projectile.

Such an arrangement is highly effective. Nonetheless the central barrel-like passage of the main projectile substantially weakens this part, so that it occasionally breaks up even before impact. This can particularly happen when the propellant charge for the secondary projectile is somewhat too powerful, a problem when the active armor in question has been phlegmatized.

OBJECTS OF THE INVENTION

It is therefore an object of the present invention to provide an improved double projectile.

Another object is the provision of such a double projectile which overcomes the above-given disadvantages, principally by maintaining the main projectile intact even when a relatively large charge is used to fire the secondary projectile off it.

SUMMARY OF THE INVENTION

A composite armor-piercing subcaliber projectile according to the invention has a front projectile part generally centered on an axis and having a rearwardly extending cylindrical sleeve of predetermined outer diameter and also generally centered on the axis and a rear projectile part centered on the axis and having a cylindrical outer surface substantially of the outer diameter and having a small-diameter forwardly extending projection fitting complementarily within the sleeve. An explosive charge between the front and rear parts can be detonated, as for example by a proximity fuse, to push the front part axially forward away from the rear part.

Since the parts are of the same outer diameter, the composite projectile is aerodynamically very stable. Once the front projectile part has separated from rear projectile part, this rear part will continue to follow its path. There is no central hole weakening the rear part, which remains an excellent impact-type projectile, that is of the type whose kinetic energy serves to pierce armor.

According to this invention the front part and sleeve are unitary. In addition the front part can be tubular and centered on the axis. Furthermore the sleeve can be separate from the front and rear parts and have a front tube centered on the axis and at least partially containing the front part, a rear tube also centered on the axis and at least partially containing the rear part, and a central crosswise partition separating the tubes. It is even possible for the rear part to have a forward extension that projects through a tubular front part, serving during separation to guide the front part and serving thereafter to ballistically guide the missile/projectile.

The front part has a guide and drive plug axially slidable in the front part ahead of the charge. In this case the detonator is mounted forward of the sleeve. In addition each of the parts is has an axial length that is a multiple of its diametral width. In this case the detonator can be in the plug.

According to another feature of this invention an aerodynamic nose cone extends between the front part and the front tube. In this case the detonator is in this cone. Usually the aerodynamic cone is formed with weakened rupture zones at which it breaks when engaged by the drive plug, although it is possible to make the cone stay on the rear part, or separate and accelerate axially forwardly with the front part. In this latter case the cone is internally complementary to the plug.

This plug according to this invention can have a rearwardly open recess receiving the charge. Alternately or in addition the projection of the rear part can have a forwardly open recess receiving the charge, in which case the partition is formed with an axially throughgoing hole. The charge can be provided only in the projection, so that after shooting off the front projectile part it blows away the sleeve. This effect can also be achieved by exploding the second-mentioned charge slightly after the first-mentioned charge, by some sort of delay connection through the partition.

The projection in such an arrangement can have a forwardly tapered end, in which case the projection is provided with a force-transmitting plug forming the forwardly open recess.

DESCRIPTION OF THE DRAWING

The above and other features and advantages will become more readily apparent from the following, it being understood that any feature described with reference to only one embodiment of the invention can be used where possible with any other embodiment. In the accompanying drawing:

FIG. 1. is an axial section through a first armor-piercing projectile according to this invention;

FIGS. 2, 3, and 4 are axial sections through second, third, and fourth projectiles in accordance with the invention;

SPECIFIC DESCRIPTION

Figure 4:
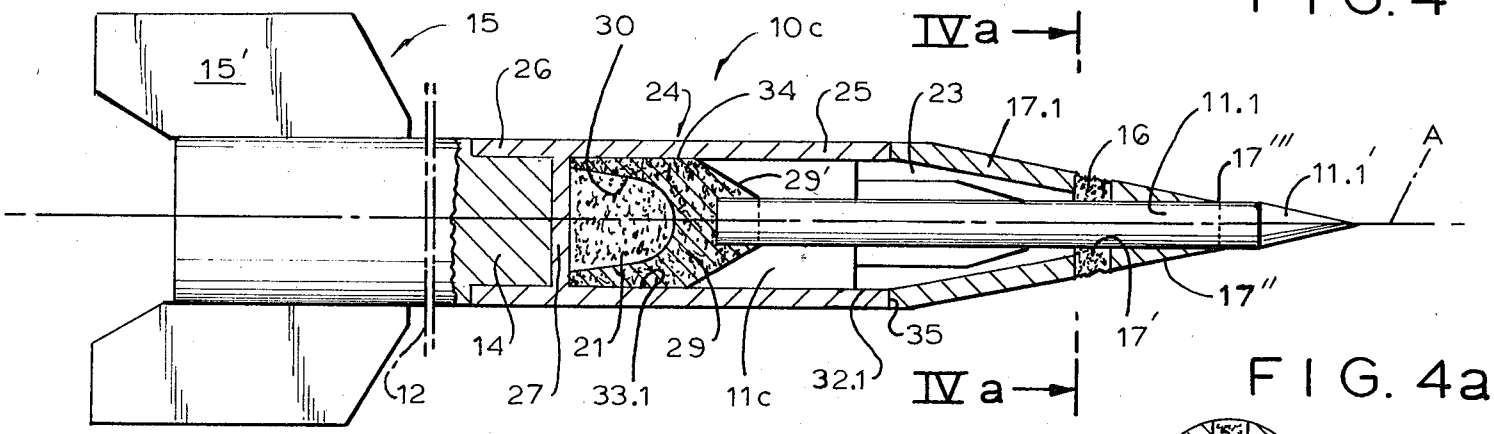

As seen in FIG. 1 a basic composite projectile 10 according to this invention has a front part 11 of basically cylindrical shape and a cylindrical rear part 12 of the same diameter D, but normally of more mass than the front part. The front end of the front part 11 carries an aerodynamic nose cone 17 containing a standard proximity fuse 16 or the like and the rear end of the rear part 12 is provided with a flight stabilizer 15 having stabilizing fins 15' (FIG. 4 only). Such an arrangement is typically held in a drive cage that is shed as is known per se when the projectile leaves the barrel from which it is shot, this being therefore a subcaliber projectile.

The rear end of the front part 11 is formed with a cylindrical backwardly projecting sleeve 13 centered on the projectile axis A and the front end of the rear part 12 is formed with a complementary forwardly projecting extension 14 that fits within the sleeve 13 but which is axially slightly shorter than this sleeve 13. A charge 21 detonated by a primer itself set off by the proximity sensor 16 is engaged in the space between the front face of the projection 14 and the rear face of the front part 11.

After being fired and shedding its drive cage, such a projectile 10 is aerodynamically very stable, since its cross section, measured perpendicular to its axis A is uniformly circular and each part has a length that is many times greater than its diameter or width. Following detonation triggered by the detector 16, when the target is a certain distance away as in the above-identified applications, the front part 11 accelerates axially forward away from the rear part 12 in an aerodynamically very stable manner as the rear-end sleeve 13 concentrates the mass of the front part 11 at its front end. Since the front part 11 is flying along the flight path which is generally aligned with or slightly tangent to the axis A it strikes the target some short period of time ahead of the rear projectile part 12. Obviously, any active armor is expended against the impact of the front projectile part 11, so that the rear part 12, which will strike exactly at this breach since it will be following the identical flight path, will easily pierce the armor.

The antipersonnel as well as the armor-piercing effect of the projectile can be enhanced as shown in FIG. 2 where, as in FIGS. 3 through 8, the same reference numerals as in FIG. 1 are used for structure that is identical and described more particularly elsewhere. Here a composite projectile **10*a* has a front part 11*a* whose rear-end sleeve 13*a* is particularly long, so that shrapnel balls 19, an explosive charge 18 and a secondary charge 21** can be contained in it. Such an arrangement is particularly effective against laminated armors.

In FIG. 3 the projectile **10*b* has a front part 11*b* which is wholly formed as a sleeve 20 that fits on the extension 13 of the rear part 12. An inwardly directed rim 20' backwardly engages a drive disk 22. A charge 21 is provided behind the disk 22 and in front of the projection 14 inside the sleeve 20, and the rear part 12 has a small-diameter extension rod 12' centered on the axis A and projecting forward through the plate 22 and past the front end of the sleeve 20**.

Explosion of the charge 21 propels the front sleeve part 20 and its plate 22 forward from the rear part 12. Once the charge is dissipated and the front part 20 is off the extension 12', the disk 22 slips out the back end of the front part 20 and same becomes aerodynamically quite streamlined. This arrangement otherwise functions substantially the same as that of FIGS. 1 and 2.

In FIG. 4 the front part **11*c* fits over a rear part 12 substantially identical to those described above, with a forward cylindrical projection 14 and fins 15' that keep it on a flight path parallel to the axis A. This front part 11*c* has a mainly tubular body 24 formed of a front tube 25, a rear tube 26 of identical diameter and fitted over projection 14, and an intermediate transverse wall 27 flatly abutting the front face of the projection 14**.

Figure 4A:
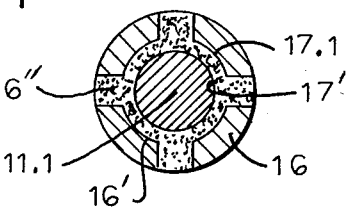
FIG. 4*a* is a large-scale section taken along line IVa—IVa of FIG. 4.

The front tube 25 has a cylindrical internal surface 33.1 that snugly fits over the cylindrical outer surface 34 of a drive plug 29 carrying a front secondary projectile 11.1. The rear end of a nose-cone 17.1 is adhered into the front end 35 of this front tube 25. This cone 17.1 is formed internally with generally axially extending weakening grooves 23 that facilitate its disintegration as will be described below and the above-described proximity sensor or detonator device 16 is also mounted in the cone 17.1 and has as shown in FIG. 4*a* a radial core 16' from which extend radial projections 16'' that are exposed through the cone 17.1. In addition the cone 17.1 is tubular, with a cylindrical inner surface 17' meeting a frustoconical outer surface 17'' at a circular front edge 17''', all centered on the axis A.

The front secondary projectile 11.1 fits snugly within the inner surface 17' and projects well forward therefrom, having a conically pointed tip 11.1' also centered on the axis. This projectile 11.1 and the rear part 12 are formed of a material of great density, preferably at least 90% by weight tungsten in a Fe-Ni matrix, whereas the drive plug 29 is formed of a light workpiece of great strength, for example a light-metal alloy or a synthetic resin in which are hollow mineral balls or glass, carbon, or other armoring fibers. The charge 21 fits within a rearwardly concave recess 30 in the plug 20.

When this projectile **10*c* approaches the target and its charge 21 is detonated, the front projectile 11.1 will move rapidly forward in the front tube 25, like a bullet in a barrel, and will break apart the nose cone 17.1 which will fly radially apart. The front projectile 11.1 will strike the target, followed by the rear part 12 and the body 25**.

Figure 5:
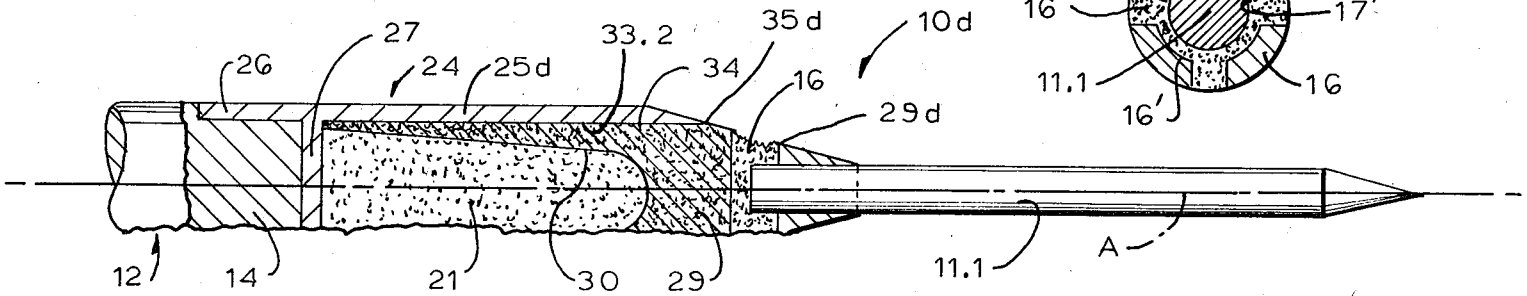
FIGS. 5, 6, 7, and 8 are axial sections through fifth, sixth, seventh, and eighth embodiments of the projectile of the present invention.

The arrangement of FIG. 5 is similar to that of FIG. 4 and 4*a*, the projectile **10*d* having a front tube 25*d* that is considerably shorter than the tube 25 of FIG. 4, and that has a frustoconical front end surface 35*d* which forms a smooth continuation of the surface 29*d* of the front end of the plug 39. There is no cone 17'1 and the sensor 16 is mounted in the plug 29. The overall length of the front tube 25*d* is the same as that of the plug 29, which is fairly long, for good guiding of the front projectile 11.1**.

Figure 6:
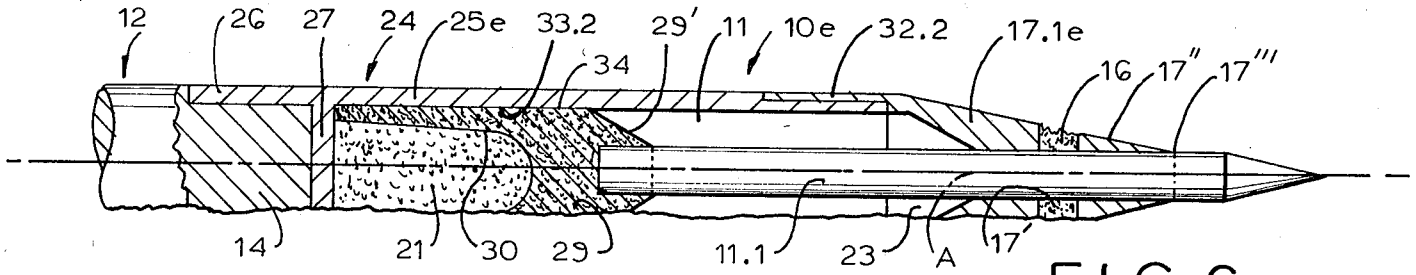

In FIG. 6 the projectile **10*e* has a particularly long front tube 25*e*, which here is slightly more than twice as long as the outer surface 33.2 of the plug 29, so as to maximize guiding. In addition this tube 25*e* has an outwardly open seat 32.2 at its front end over which the rear end of the cone 17.1*e* fits to maximize the length of the internal guiding surface 33.2. Here after the charge 21 is fired and the plug 29 is at the front end of the tube 25*e*, it will destroy this cone 17.1**.

Figure 7:
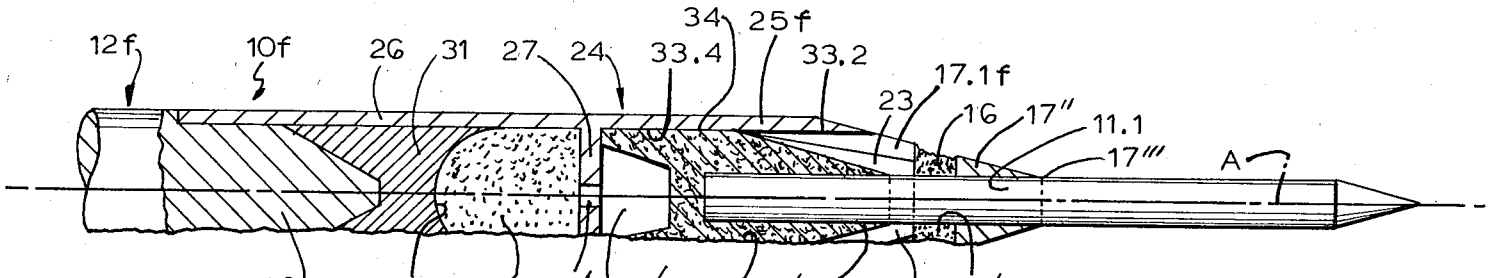

The projectile of FIG. 7 is substantially the same as that of FIG. 4, except that the rear part 12*f* has a front projection 14*f* of frustoconical shape and fitted into a seat-forming element 31 having a forwardly open and part-spherically concave cavity 36 in which is received the charge 21, although this cavity 36 could be formed directly in the front end of a cylindrical projection 14. A hole 27' through the partition 27 allows the gases created by detonation of the charge 20 to pass through to a cavity 30' in the rear of the plug 29. Here after the charge 21 is fired and the plug 29 is at the front end of the tube 25*e*, it will destroy the cone 17.1*f*, which is formed of a fragile synthetic resin like all of the other above-described sacrificial nose cones. The pressure in the chamber 35, however, will suffice to push off the body 25*f* once the front part 11.1 has separated. Thus the rear part 12*f* will directly strike the active-armor cell that was deactivated by the front front part 11.1.

Figure 8:
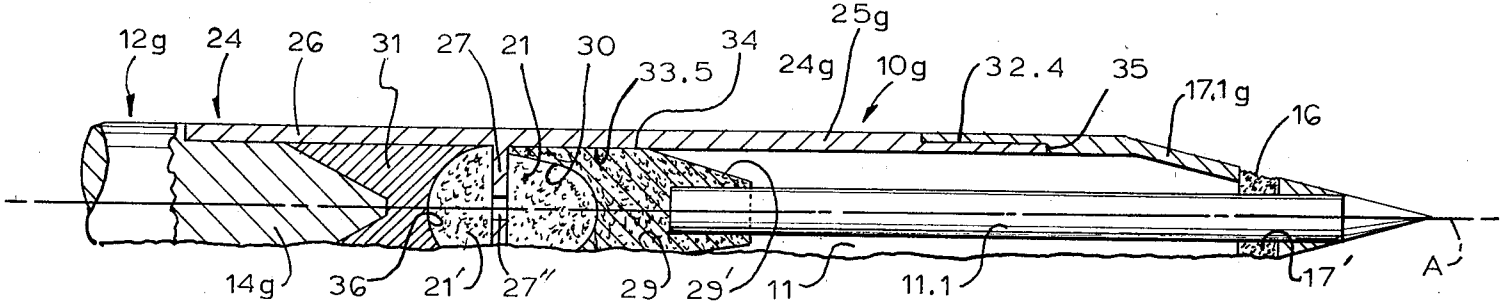

In FIG. 8 the rear part 12*g* and plug 29 are similar to those of FIG. 7, except that the cavity 30 here is filled with a charge 21 and another delayed charge 21' is provided in the cavity 36. In addition there are no weakening grooves 23 on the cone 17.1*g*. Thus when fired the plug 29 will fit snugly and complementarily in this cone 17.1*g* and will pull it off the body 24. This body 24*g* is made of steel to contain the charge, but is not effective against an armored target. The cone 17.1*g* is of a fiber-reinforced synthetic resin so it is not destroyed when entrained by the front projectile 11.1. The second charge 21' delayed by the connection 27'' will separate the body 24*g* so the hard extension 14*g* can directly strike the armor cell deactivated by the front part 11.1.

We claim:

1. A composite armor-piercing projectile comprising:

a front projectile part generally centered on an axis;

a cylindrical sleeve of predetermined outer diameter and also generally centered on the axis, the sleeve having a front tube centered on the axis and at least partially containing the front part, a rear tube also centered on the axis and extending axially rearward from the front tube, and a crosswise partition separating the tubes; a guide in the front tube;

a drive plug axially slidable in the guide of the front tube and carrying the front part;

a rear projectile part centered on the axis, having a cylindrical outer surface substantially corresponding to the outer diameter of the sleeve, and having a forwardly extending projection fitting complementarily within the rear tube of the sleeve, the front projectile part having a smaller diameter than the rear projectile part;

a first explosive charge in the sleeve between the front and rear parts; and detonator means for exploding the first charge and pushing the front part and the plug axially forward in the guide of the front tube away from the rear part.

2. The composite projectile defined in claim 1 wherein each of the parts is an axial length that is a multiple of its diametral width.

3. The composite projectile defined in claim 1 wherein the detonator means is in the plug.

4. The composite projectile defined in claim 1, further comprising an aerodynamic nose cone extending between the front part and the front tube.

5. The composite projectile defined in claim 4 wherein the detonator means is carried in the cone.

6. The composite projectile defined in claim 4 wherein the aerodynamic cone is formed with weakened rupture zones at which it breaks when engaged by the drive plug.

7. The composite projectile defined in claim 4 wherein the cone is internally complementary to the plug.

8. The composite projectile defined in claim 1 wherein the plug is formed with a rearwardly open recess receiving the first explosive charge.

9. The composite projectile defined in claim 1 wherein the projection has a forwardly open recess receiving the first explosive charge, the partition being formed with an axially throughgoing hole.

10. The composite projectile defined in claim 1 wherein the plug is formed with a rearwardly open recess and the projection has a forwardly open recess, both recesses receiving the first explosive charge, the partition being formed with an axially throughgoing hole at the charge and rearwardly open recess.

11. The composite projectile defined in claim 1 wherein the plug is formed with a rearwardly open recess containing the first explosive charge and the projection has a forwardly open recess receiving another such charge.

12. The composite projectile defined in claim 11, further comprising means for exploding the another such charge slightly after the first explosive charge.

13. The composite projectile defined in claim 11 wherein the projection has a forwardly tapered end.

14. The composite projectile defined in claim 13 wherein the projection is provided with a force-transmitting plug forming the forwardly open recess.

* * * * *